US010470576B2

(12) United States Patent
DeJule

(10) Patent No.: US 10,470,576 B2
(45) Date of Patent: Nov. 12, 2019

(54) MOVABLE HUMAN SUPPORT STRUCTURE

(71) Applicant: Aaron DeJule, River Forest, IL (US)

(72) Inventor: Aaron DeJule, River Forest, IL (US)

( * ) Notice: Subject to any disclaimer, the term of this patent is extended or adjusted under 35 U.S.C. 154(b) by 0 days.

(21) Appl. No.: 15/584,580

(22) Filed: May 2, 2017

(65) Prior Publication Data

US 2017/0318969 A1 Nov. 9, 2017

Related U.S. Application Data

(60) Provisional application No. 62/354,428, filed on Jun. 24, 2016, provisional application No. 62/331,716, filed on May 4, 2016.

(51) Int. Cl.

| | |
|---|---|
| ***A47D 13/10*** | (2006.01) |
| ***A47C 3/02*** | (2006.01) |
| ***A47C 7/44*** | (2006.01) |
| ***A47C 7/46*** | (2006.01) |
| ***A47C 7/14*** | (2006.01) |
| ***A47C 3/025*** | (2006.01) |
| ***A47C 3/026*** | (2006.01) |
| *A47C 7/54* | (2006.01) |
| *A47C 7/40* | (2006.01) |

(52) U.S. Cl.

CPC ..... *A47C 7/445* (2013.01); *A47C 3/026* (2013.01); *A47C 3/0255* (2013.01); *A47C 7/14* (2013.01); *A47C 7/46* (2013.01); *A47D 13/105* (2013.01); *A47C 7/40* (2013.01); *A47C 7/54* (2013.01)

(58) Field of Classification Search

CPC .. A47C 7/445; A47C 7/14; A47C 7/46; A47C 7/40; A47C 7/54; A47C 3/02; A47C 3/025; A47C 3/0252; A47C 3/0255; A47C 3/026; A47C 3/027; A47C 9/02; B64D 11/0689; A47D 13/105; A47D 13/10; A47D 13/107; A47D 9/02

See application file for complete search history.

(56) References Cited

U.S. PATENT DOCUMENTS

| | | | | | |
|---|---|---|---|---|---|
| 257,873 | A * | 5/1882 | Klein | A47C 3/0255 | 297/280 |
| 285,665 | A * | 9/1883 | Peck | A47C 3/0255 | 297/278 |
| 402,469 | A * | 4/1889 | Messmore | A47C 3/0255 | 297/278 |
| 523,337 | A * | 7/1894 | Ebert | A47D 9/00 | 5/101 |
| 596,451 | A * | 12/1897 | Babcock | A47C 3/0255 | 297/281 |

(Continued)

*Primary Examiner* — Kyle J. Walraed-Sullivan

(74) *Attorney, Agent, or Firm* — Wood, Phillips, Katz, Clark & Mortimer

(57) ABSTRACT

A movable human support structure has a support against which at least a part of a human can be borne in use, a base, and a first motion transmitting assembly acting between the support and the base. The first motion transmitting assembly has at least one link member connecting between the base and the support. The at least one link member is configured to be movable: a) relative to the support around a first axis; and b) relative to the base around a second axis. The first and second axes are non-parallel to each other. The first motion transmitting assembly is configured to guide movement of the support relative to the base in opposite directions in a non-straight path.

22 Claims, 7 Drawing Sheets

(56) References Cited

U.S. PATENT DOCUMENTS 616,697 A * 12/1898 Clemson ..... A47D 13/107 248/595
998,689 A * 7/1911 Irvine ..... A47C 3/0255 5/121
1,325,358 A * 12/1919 Elzey ..... A47C 3/0255 248/327
1,379,082 A * 5/1921 Cavanaugh ..... A47D 13/105 297/280
1,557,498 A * 10/1925 Looney ..... A47D 13/105 297/181
1,740,949 A * 12/1929 Luery ..... A47D 13/105 297/174 R
3,288,421 A * 11/1966 Peterson ..... B23Q 1/5462 108/4
3,577,659 A * 5/1971 Kail ..... B25J 17/0216 248/163.1
4,304,437 A * 12/1981 Longo ..... A63G 9/12 297/277
4,452,446 A * 6/1984 Saint ..... A47D 13/105 472/119
4,996,732 A * 3/1991 Chang ..... A47D 9/02 5/101
5,376,053 A * 12/1994 Ponder ..... A63G 9/16 472/119
5,704,882 A * 1/1998 Coates ..... A47C 3/0252 297/273
6,030,039 A * 2/2000 Essler ..... A47C 15/008 128/845
6,478,267 B1 * 11/2002 Whitman ..... B60N 2/3097 248/157
6,896,575 B2 * 5/2005 Fair ..... A63H 33/006 297/16.1
6,942,487 B2 * 9/2005 Corbalis ..... A63B 69/0093 280/818
6,958,017 B1 * 10/2005 Toombs, Jr. ..... A63G 9/00 297/273
7,367,068 B2 * 5/2008 Huff ..... A45F 3/22 472/118
7,666,126 B2 * 2/2010 Rempe ..... A63B 22/18 482/121
8,074,369 B2 * 12/2011 McMurtry ..... B25J 17/0266 33/503
9,068,622 B2 * 6/2015 Malchev ..... F16F 15/027
D735,819 S * 8/2015 Louis ..... D21/686
9,536,446 B2 * 1/2017 Vatcher ..... A63G 31/16
9,925,101 B2 * 3/2018 Kuenzler ..... A47C 20/04
9,943,725 B2 * 4/2018 Todd ..... A63B 21/4033
2005/0176340 A1 * 8/2005 Gubitosi ..... A47D 13/105 446/227
2006/0079378 A1 * 4/2006 Ader ..... A63B 5/16 482/26
2007/0040431 A1 * 2/2007 Bapst ..... A47D 13/105 297/274
2007/0102968 A1 * 5/2007 Pearse ..... A47C 7/024 297/158.1
2007/0205646 A1 * 9/2007 Bapst ..... A47D 9/02 297/261.1
2007/0262627 A1 * 11/2007 Clapper ..... A47D 9/02 297/260.2
2007/0267904 A1 * 11/2007 Clapper ..... A47D 9/02 297/256.16
2008/0012409 A1 * 1/2008 Chen ..... A47D 13/107 297/274
2009/0036225 A1 * 2/2009 Tseng ..... A47C 3/0255 472/125
2009/0230743 A1 * 9/2009 Derakhshan ..... A47C 9/002 297/329
2009/0236886 A1 * 9/2009 Tseng ..... A47C 3/0255 297/281
2010/0052376 A1 * 3/2010 Hopke ..... A47D 9/02 297/188.01
2010/0279783 A1 * 11/2010 Tseng ..... A47C 3/0255 472/118
2010/0320821 A1 * 12/2010 Trapp ..... A47D 13/107 297/274
2011/0018320 A1 * 1/2011 Schneider ..... B60N 2/24 297/216.17
2011/0233975 A1 * 9/2011 Mindel ..... B60N 2/24 297/216.17
2011/0319181 A1 * 12/2011 Miller ..... A63G 9/16 472/119
2012/0175928 A1 * 7/2012 Eber ..... A47C 3/0255 297/311
2012/0264530 A1 * 10/2012 Gilbert ..... A47D 13/105 472/118
2013/0093227 A1 * 4/2013 Mendes ..... A47D 13/107 297/274
2013/0154324 A1 * 6/2013 Xu ..... C04B 35/62889 297/259.3
2013/0184088 A1 * 7/2013 Haut ..... A47D 13/10 472/119
2013/0244803 A1 * 9/2013 Haut ..... A47D 9/02 472/119
2013/0306826 A1 * 11/2013 Pleiman ..... A47B 81/00 248/423
2014/0018179 A1 * 1/2014 Mountz ..... A47D 13/105 472/119
2014/0265490 A1 * 9/2014 Hopke ..... A47D 9/02 297/260.2
2014/0287846 A1 * 9/2014 Mountz ..... A47D 9/02 472/118
2015/0048667 A1 * 2/2015 DeJule ..... A47C 7/00 297/463.1
2015/0174450 A1 * 6/2015 Jhang ..... A63B 69/0093 482/146
2015/0265068 A1 * 9/2015 Ferraro ..... A47D 13/105 472/118
2015/0343924 A1 * 12/2015 Takeuchi ..... B60N 2/39 297/314
2016/0206096 A1 * 7/2016 Chen ..... A47C 7/66
2016/0286977 A1 * 10/2016 Thomson ..... A47D 1/004
2017/0208964 A1 * 7/2017 Luginin ..... A47D 9/02
2017/0280891 A1 * 10/2017 Mountz ..... A47D 13/105

* cited by examiner

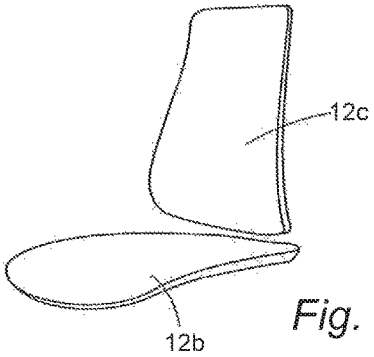
Fig. 7
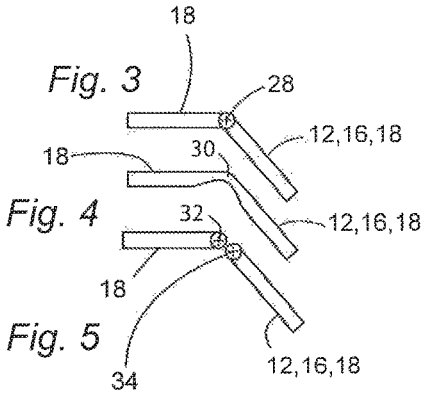
Fig. 3
Fig. 4
Fig. 5
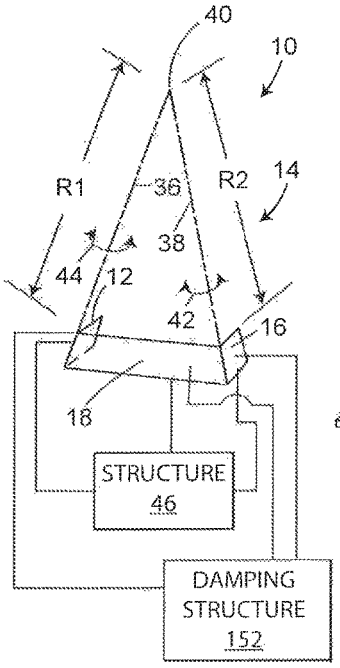
Fig. 8
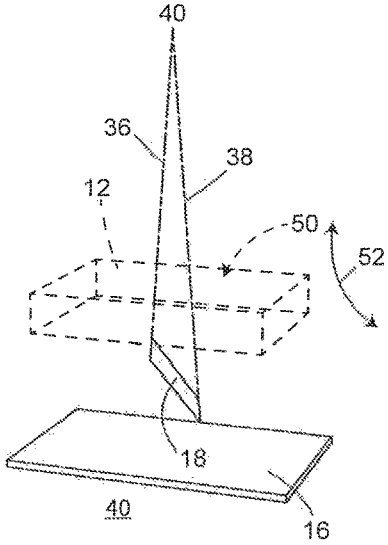
Fig 9
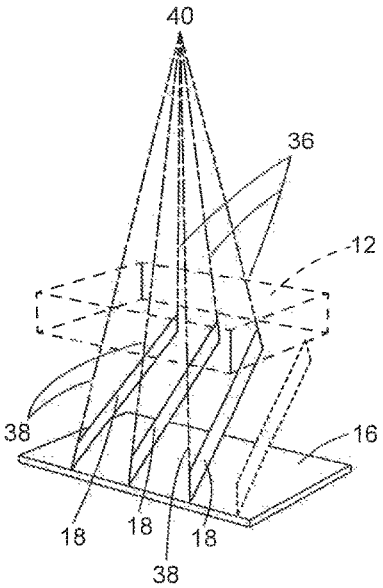
Fig. 10

Fig. 15
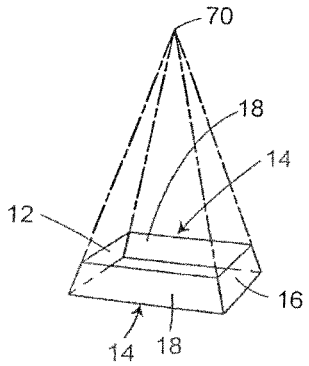
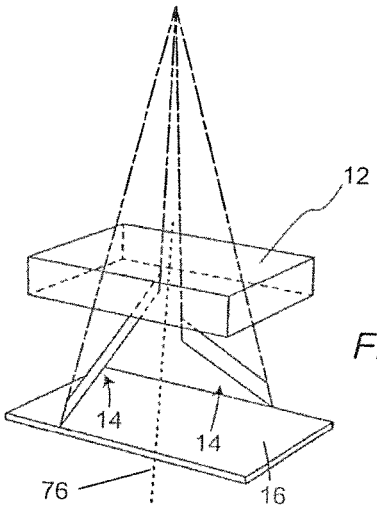
Fig. 17
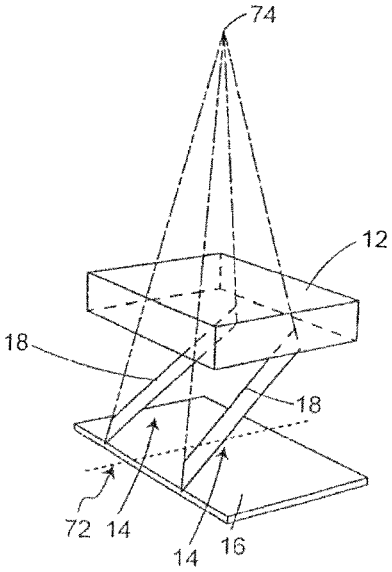
Fig. 16
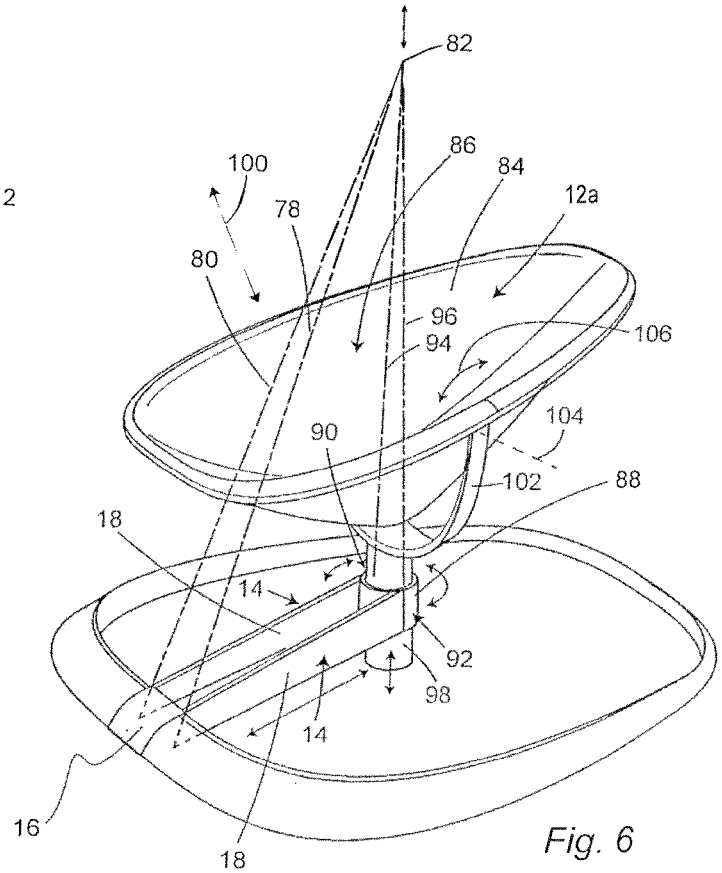
Fig. 6

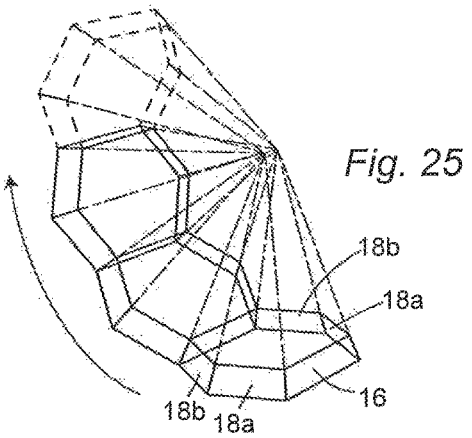
Fig. 25
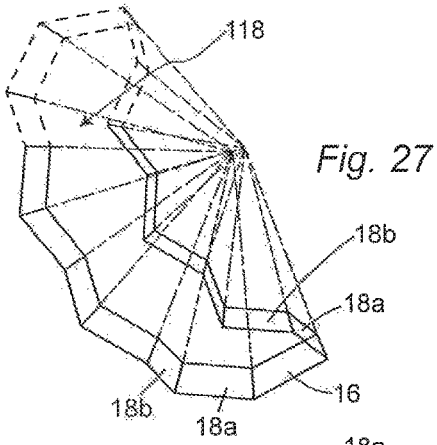
Fig. 27
Fig. 26
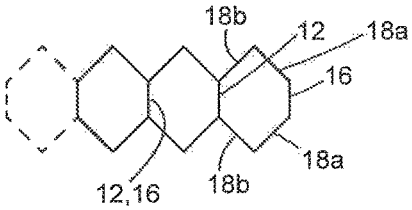
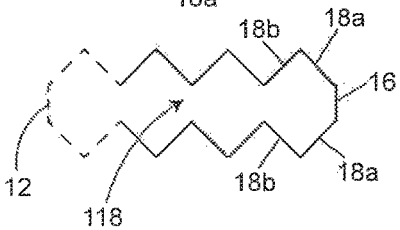
Fig. 28
Fig. 29
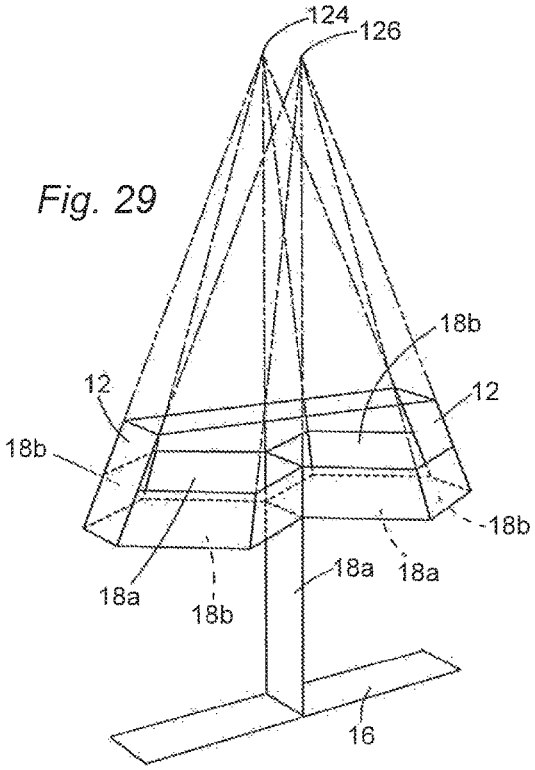
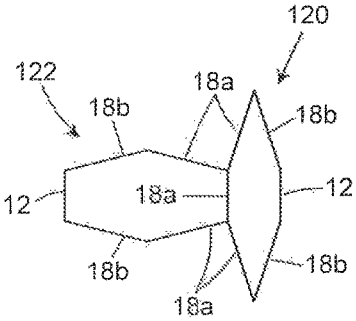
Fig. 30

MOVABLE HUMAN SUPPORT STRUCTURE

BACKGROUND OF THE INVENTION

Field of the Invention

This invention relates to structures for supporting part or all of a user and, more particularly, to a structure that allows the support for the user to be moved back and forth in a controlled path.

Background Art

Decades of research studies indicate that a repetitive rocking motion has a positive effect on people of all ages. The rocking motion has been shown to benefit those suffering from various ailments, to the extent that some have adopted the label "Rocking Chair Therapy".

In one 1998 study of nursing home residents, University of Rochester School of Nursing, researchers found that patients with Alzheimer's disease who rock for 1-2 hour per day in a chair "demonstrated significant improvements in depression, anxiety, and balance and a decrease in pain medication usage," In another study, researchers demonstrated rocking improved circulation to the brain. Some physiotherapists claim rocking may produce a sedative effect and aid in pain management, easing lower back pain. The potential benefits extend to the relief of psychological symptoms of anxiety and depression.

However, rocking back and forth on curved slats bearing against a rigid surface causes a jerking motion—thereby detracting from the rocking experience.

It is commonly known that infants and babies have been soothed in automated infant swings and nursery rocking/gliding chairs for many years. Today, according to the National Center for Health Statistics (NCHS) in the United States, the fast pace of modern lifestyles and increasingly career-oriented mothers are driving a preference for convenience and the need for "time-saving and easy-to-use" baby care devices. Industry challenges are associated with child safety including the risk of falls, posture, and the like.

A variety of apparatus incorporate swinging, gliding, rocking or bouncing motion to provide users—from infant to adult—with relaxation, comfort, improved circulation and other benefits. In a sitting, prone, or upright position, current designs for infants and baby swings commonly provide either front-to-back or side-to-side motion.

In one common swing configuration, a seat or cradle is attached and suspended above the ground from the top of a frame where a motor is located to create an arcuate swinging motion. The motor may be adjacent to the center of a radius for the arc. To take advantage of a full range of swinging motion and benefit from a longer smoother swing, the center/pivot point of the frame must be positioned a substantial distance above the seated user. The overall frame must thus be made correspondingly larger to provide a stable support. Current manufacturers offer small-medium-large designs. Taller swings may be top heavy, thus presenting safety concerns. Furthermore, the motor and lines of attachment residing above the user may serve to block visibility of, for example, an infant in distress, and limit immediate access when necessary.

In another common configuration, a cradle or seat is provided on a frame and attached on the sides thereof to enable front-to-back and/or side-to-side motion in a glider design. In contrast to attaching a seat or cradle from above the seated user, the gliding design configurations limit motion to short, front-to-back or side-to-side. While the seated user is not obstructed from view or accessibility, structural parts of the frame may trap or pinch a body part of the user.

Among the various designs for adult rocking, gliding chairs, and baby swings and gliders, each affords less than optimal comfort, health benefits, economy of space, and/or safety. In addition to safety issues, bulk configurations, large footprints and complex motion mechanisms, such apparatus may not be practical for small living quarters such as apartments.

SUMMARY OF THE INVENTION

In one form, the invention is directed to a movable human support structure made up of: a support against which at least a part of a human can be borne in use; a base; and a first motion transmitting assembly acting between the support and the base. The first motion transmitting assembly has at least one link member connecting between the base and the support. The at least one link member is configured to be movable: a) relative to the support around a first axis; and b) relative to the base around a second axis. The first and second axes are non-parallel to each other. The first motion transmitting assembly is configured to guide movement of the support relative to the base in opposite directions in a non-straight path.

In one form, the at least one link member comprises a first substantially rigid link member having spaced locations movable relative to the support and base respectively around the first and second axes.

In one form, the non-straight path is an arcuate path having a radius.

In one form, the first motion transmitting assembly is configured so that the support traces first and second separate arcs as the support moves in the non-straight path.

In one form, the invention further includes a second motion transmitting assembly connecting between the support and the base. The second motion transmitting assembly is made up of at least a second link member connecting between the base and the support. The at least second link member is configured to be movable: a) relative to the support around a third axis; and b) relative to the base around a fourth axis. The third and fourth axes are non-parallel to each other.

In one form, the first and second axes converge towards a pivot location.

In one form, the first and second axes converge towards a first pivot location. The third and fourth axes converge towards a second pivot location that is spaced from the first pivot location.

In one form, the first, second, third, and fourth axes converge towards a single pivot location.

In one form, the at least one link member is made up of a plurality of link members. First and second of the plurality of link members are connected to each other for relative movement around another axis that is non-parallel to the first and second axes.

In one form, two of the first, second, third, and fourth axes are shared/coincident.

In one form, the first motion transmitting assembly is configured so that the radius of the arc can be selectively changed.

In one form, at least one of the at least one link member and at least one of the at least second link member is a shared link member between the first and second motion transmitting assemblies.

In one form, the first and second axes are at an angle with respect to each other. The first motion transmitting assembly is configured so that the angle between the first and second axes can be selectively changed.

In one form, the first motion transmitting assembly is configured so that the at least one link member can be selectively disconnected from one of: a) another link member making up the at least one link member; b) the base; and c) the support to facilitate collapsing/compaction of the movable human support structure.

In one form, the invention further includes structure in addition to the link members cooperating between components on each of the first and second motion transmitting assemblies to coordinate movement between the components on the first and second motion transmitting assemblies as the support moves relative to the base in the non-straight path.

In one form, the pivot location is above the support.

In one form, the support is in the form of one of: a) a seat; or b) a cradle for an infant.

In one form, the support is in the form of one of: a) a seating surface; and b) a back support surface.

In one form, the invention is provided in combination with a drive for moving the support in the non-straight path.

In one form, the first motion transmitting assembly comprises structure for one of: a) fixing the support in a selected position relative to the base; and b) selecting different ranges of movement for the support in the non-straight path.

In one form, the first and second axes each extends primarily in a vertical direction.

BRIEF DESCRIPTION OF THE DRAWINGS

FIGS. 3-5 show alternative forms of connectors between the base, support, and link members that allow relative movement therebetween around an axis;

FIG. 6 is a perspective view of one specific form of the human support structure, as shown schematically in FIG. 1, with the support in the form of an infant cradle;

FIG. 7 is a perspective view of a seat and backrest making up supports on a chair into which the invention can be incorporated;

FIG. 8 is a schematic representation of one form of motion transmitting assembly;

FIG. 9 is a schematic representation of the motion transmitting assembly as in FIG. 8 connected between a more specific form of base and support;

FIG. 10 is a schematic representation of a plurality of the motion transmitting assemblies, as in FIGS. 8 and 9, connecting between a support and base;

FIG. 15 is a schematic representation of a mirrored arrangement of motion transmitting assemblies, with the construction as in FIG. 11;

FIGS. 16 and 17 are schematic representations showing different arrangements of multiple motion transmitting assemblies, as shown in FIG. 11, connecting between supports and bases;

FIGS. 22-30 are schematic representations of further alternative forms of human support structure incorporating different arrangements of motion transmitting assemblies;

DETAILED DESCRIPTION OF THE PREFERRED EMBODIMENT

Figure 1:
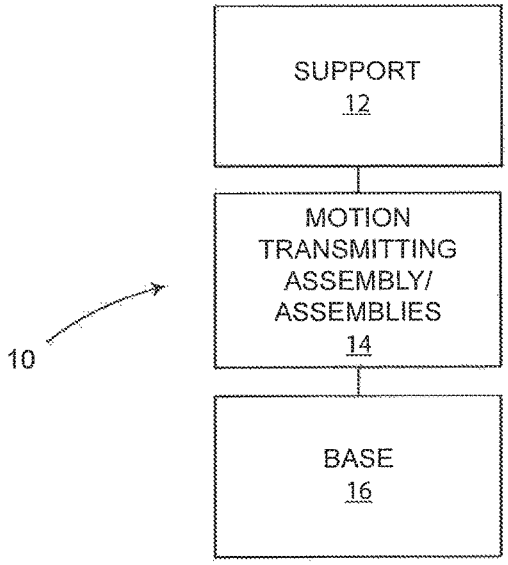
FIG. 1 is a schematic representation of a movable human support structure, according to the invention, and including a support on which all or part of a user can bear, a base, and at least one motion transmitting assembly connecting between the support and base.

In FIG. 1, a schematic representation of a movable human support structure, according to the present invention, is shown at 10. The structure 10 is designed to support ail or part of an adult or infant human in a manner whereby the supported part(s) can be repeatedly moved in opposite directions in a controlled path.

The structure 10 includes a support 12 against which a part, or the entirety, of the user can be borne. One or more motion transmitting assemblies 14 acts between the support 12 and a base 16, which may be a fixed structure or a dedicated structure which makes the support 12, motion transmitting assembly/assemblies 14, and base 16 a self-contained unit that might be repositionable and/or transportable to different locations.

The schematic showing of the support 12 is intended to encompass virtually any structure that supports part or all of a user, regardless of size or age. As just examples, the support 12 may be a seat, a backrest, a crib, a chair, a baby seat, a stool, a playground swing, a harness support, a hammock, a horizontal lounge seat, etc. The structure can incorporate other features found in conventional swing products, such as rockers, gliders, baby swings, nursery chairs, playground swings, etc.

Figure 2:
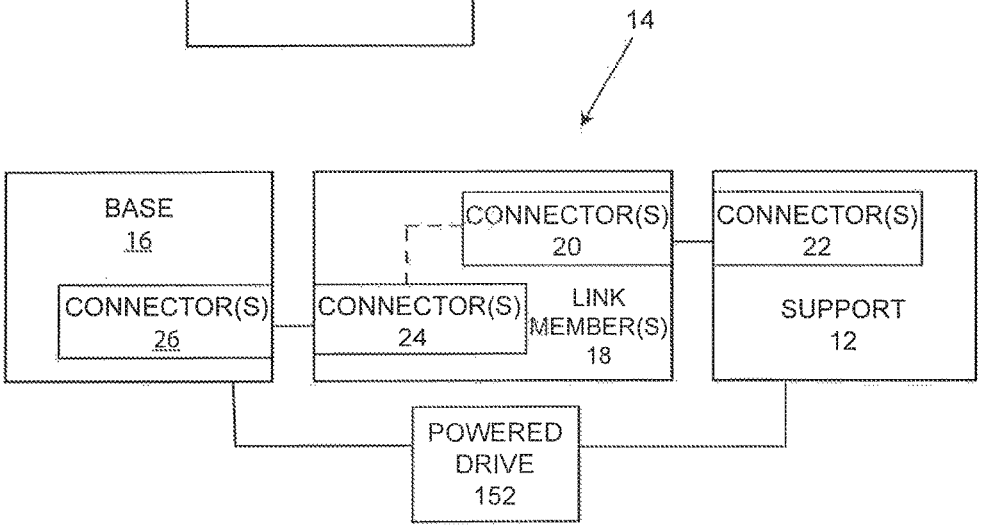
FIG. 2 is a schematic representation of the motion transmitting assembly in FIG. 1 and showing additional details thereof.

As shown in FIG. 2, one exemplary motion transmitting assembly 14 consists of at least one link member 18 acting between the base 16 and support 12. At least one connector 20 on one of the link members 18 is configured to cooperate with at least one connector 22 on the support 12. The connectors 20, 22 interact to guide movement between the link member 18 and support 12 around a common axis, or adjacent axes which, for purposes of simplifying the explanation herein, will be considered a single axis.

The same or another link member 18 has at least one additional connector 24 which cooperates with at least one connector 26 on the base 16 to guide relative movement between the link member 18 and base 16 around a separate axis.

The link member connectors 20, 24 may interact, when there is more than one link member 18 acting between the support 12 and base 16, to guide relative movement between the link members 18 around an additional axis.

At least two of the axes, and preferably all of the axes, in the motion transmitting assembly 14 are in non-parallel relationship to each other. In one preferred form as for a basic seating support 12, the axes are oriented primarily in a vertical direction.

The schematic showing of the connectors 20, 22, 24, 26 in FIG. 2 is intended to encompass virtually an unlimited number of different configurations thereof. Exemplary connector structures, which are not intended to be limiting, are shown in FIGS. 3-5.

As shown in FIG. 3, a link member 18 is connected to a support 12, base 16, or another link member 18 for pivoting movement around a fixed single axis 28.

FIG. 4 shows an alternative pivot connection wherein one link member 18 is connected to the support 12, base 16, or another link member 18 through a live hinge arrangement through which the components are effectively moved relative to each other around an axis 30.

FIG. 5 shows an arrangement of connectors wherein a link member 18 and the associated support 12, base 16, or separate link member 18, are movable independently about adjacent axes 32, 34. The axes 32, 34 are in close enough proximity that they can be treated as a single axis for purposes of the description and claims herein.

Similarly, while the live hinge arrangement does not produce a precise pivot action around a single line, the components will be considered, for purposes of simplicity herein, to be movable relative to each other around a single axis.

In another form, leaf springs and torsion bars might be utilized to turn one component relative to the other around an axis.

Ball-in-socket arrangements present another option. Within one design structure a mix and match of different rotational joints could be used. For example, one area can have molded parts with molded integrated hinges and another area of the design mechanical hinges. Similarly, the entire mechanism, including its axes, could be one molded part—for example, a co-injection part—allowing for flexibility at the hinges and rigidity at the linkages.

Exemplary forms of the support 12 are shown in FIGS. 6 and 7. FIG. 6 shows a support 12*a* in the form of an infant cradle.

In FIG. 7, separate supports 12*b*, 12*c* are shown as a seat, and a backrest, respectively, which may be usable for an infant or adult.

As noted above, the support 12 is not limited to any specific configuration. It is contemplated that virtually any element/surface against which part or all of a user bears, to be movable in opposite directions in a non-straight/non-linear path, may be combined with the motion transmitting assembly/assemblies 14 and base 16, as shown schematically in FIG. 1.

The precise construction of the link members 18 is not critical to the invention. Generally, each of the link members will be described as having a substantially rigid construction between spaced locations whereat the connectors 20, 24 are located. In numerous of the examples hereinbelow, the link members 18 are shows as generally flat panels with a generally polygonal peripheral shape. This is not a requirement.

A basic motion transmitting assembly, shown at 14 in FIG. 8, defines one form of basic "building block" that is usable alone, with a like motion transmitting assembly, and/or with other structure. The motion transmitting assembly 14 has a link member 18 joined to a support 12 and base 16 through appropriate connectors (details not shown but shown generically in FIG. 2) so that the link member 18 pivots relative to the support 12 around an axis 36 and the link member 18 and base 16 are movable relative to each other around a separate axis 38. The axes 36, 38 converge to, or towards, a pivot location 40.

Standing alone, the structure 10 in FIG. 8, shown to include the motion transmitting assembly 14, support 12, and base 16, is configured so that with the base 16 held in a fixed position, the support 12 traces a first arc by moving with the link member 18 around the axis 38, as indicated by the double-headed arrow 42. The support 12 traces a second arc by moving relative to the link member 18 around the axis 36, as indicated by the double-headed arrow 44.

Structure, shown generically at 46, may interact with the support 12, link member 18, and/or base 16 to control/alter the manner in which the support 12, link member 18, and base 16 move relative to each other. The structure 46 may take a variety of different forms and may include, for example, one or more additional motion transmitting assemblies, as hereinafter described, or other structure that may be manually or automatically operated either in response to a user's application of force upon the support 12 or independently of any outside influence.

The non-straight path may be controlled to be essentially arcuate with the FIG. 8 configuration with the radius of the arc being determined by the radii R1, R2, respectively between the pivot location 40 and the connection locations of the support 12 and link member 18 and link member 18 and base 16.

FIG. 9 shows a slightly more specific form of the base 16 and support 12, as shown generically in FIG. 8. As depicted, the support 12 is maintained in a spaced, elevated relationship with the base 16, that is maintained on a foundation 48 either movably or fixedly in relationship thereto. The support 12 defines an upwardly facing support region/surface at 50, which may be a seat, a cradle, etc. The link member 18 angles upwardly from the base 16 to maintain the support 12 in the elevated position shown. The link member 18 connects to the base 16 for relative movement about the axis 38, that is oriented primarily in a vertical direction. The support 12 is joined to the link member 18 for pivoting movement about the axis 36, also having primarily a vertical orientation. The axes 36, 38 converge at the aforementioned pivot location 40.

The support 12 can be moved back and forth in a path that is nominally arcuate, as indicated by the double-headed arrow 52. The path is actually a combination of the arcuate movements traced by the support 12, as indicated by the double-headed arrows 42, 44 in FIG. 8.

With the motion transmitting assembly 14, turning of components around the axis may facilitate collapsing of the structure 10, as for storage and/or transportation. This same concept can be used to reconfigure any of the embodiments with the different form of motion transmitting assembly, as described herein.

The basic building block shown in FIGS. 8 and 9 might be connected or duplicated by mirroring, rotating, patterning, offsetting, etc. Various axes and linkages may be strategically shared between the "building blocks", support 12 and base 16.

One exemplary form of the structure 46 in FIG. 8, combined with the basic building block/motion transmitting assembly 14, is shown in FIG. 10. Three like link members 18 are connected between the support 12 and base 16 in a manner that the axes 36, 38 associated with each of the "building blocks" converges to the pivot location 40. Each of the link members 18, together with the base 16 and support 12, makes up a separate motion transmitting assembly, with the motion transmitting assemblies interacting to produce a different permissible, non-straight path for the support 12, which can move back and forth in a controlled manner within this path.

Figure 11:
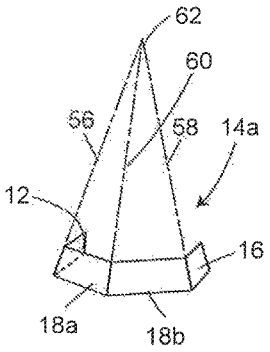
FIG. 11 is a view as in FIG. 8 of another form of motion transmitting assembly connecting between a base and support.

FIG. 11 depicts another form of building block/motion transmitting assembly 14*a* wherein there are separate link members 18*a*, 18*b* connecting between the support 12 and base 16.

The link member 18*a* is connected to the support 12 for pivoting movement relative thereto around an axis 56. The link member 18*b* is pivotable relative to the base 16 around an axis 58. The link members 18*a*, 18*b* are movable relative to each other around an axis 60. As depicted, the axes 56, 58, 60 converge towards a pivot location 62.

Figure 12:
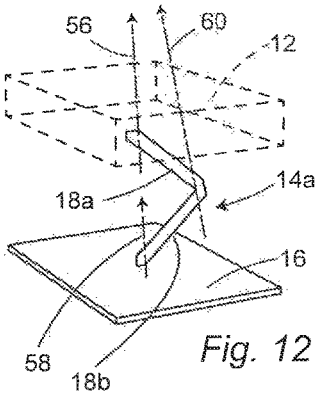
FIG. 12 is a schematic representation of the motion transmitting assembly in FIG. 11 connected between a more specific form of base and support.

FIG. 12 shows a more specific form of the motion transmitting assembly 14*a* in FIG. 11 associated with a support 12 and base 16 as in FIG. 9.

Figure 13:
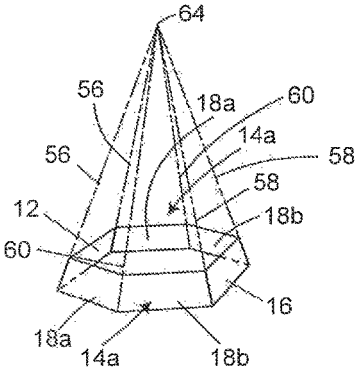
FIG. 13 is a view as in FIG. 11 wherein the motion transmitting assembly is in a mirrored arrangement with all pivot axes between components converging towards a single pivot point.

FIG. 13 shows a mirrored arrangement of the motion transmitting assemblies 14*a* in relationship to a support 12 and base 16. In FIG. 13, all axes 56, 58, 60 converge to or towards a single pivot location 64.

Figure 14:
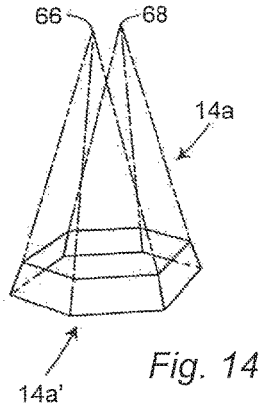
FIG. 14 is a view as in FIG. 13 showing a modified form of mirrored motion transmitting assembly wherein pivot axes converge towards spaced points.

FIG. 14 shows a modified form of the motion transmitting assemblies in FIG. 13 at 14*a*' wherein the axes on each of the motion transmitting assemblies 14*a*' converge towards different pivot locations 66, 68, which are spaced from each other.

FIG. 15 shows a mirrored arrangement of the motion transmitting assembly 14, as shown in FIG. 8, with all axes converging toward a single pivot location 70.

FIG. 16 shows a more specific form of a support 12 and base 16 with a mirrored arrangement of the motion transmitting assemblies 14. Symmetry is about the dotted line, as indicated by the arrow 72. All axes converge towards a single pivot location 74.

FIG. 17 shows a different arrangement of multiple motion transmitting assemblies 14 between a support 12 and base 16. The motion transmitting assemblies 14 are turned with respect to each other around an axis 76.

In FIG. 6, the mirrored arrangement of motion transmitting assemblies 14 is shown integrated into a more specific, exemplary form of support 12*a* and base 16. The base 16 is ring-shaped. The link members 18 are connected to the base 16 for movement around separate axes 78, 80 that converge towards a pivot location 82.

The support 12*a* has different parts including a main body 84 defining a receptacle 86, as for a user to sit or an infant to be placed in a cradling arrangement.

The support 12*a* further includes a mounting portion 88. The link members 18 are connected to the mounting portion 88 at diametrically opposite locations 90, 92 for pivoting movement around axes 94, 96, which likewise converge towards the pivot location 82.

The body 84 has a depending stem 98 that telescopies within the mounting portion 88 to allow the height of the receptacle 86 to be changed relative to the base 16.

The motion transmitting assemblies 14 guide movement of the support 12*a* relative to the base 16 in a non-straight path which, as depicted, is curved/arcuate, as indicated by the double-headed arrow 100.

In this embodiment, the stem 98 extends upwardly to a U-shaped holder 102 that straddles a main part of the body 84. The body 84 can be pivotably connected to the holder 102 to allow the inclination thereof to be changed by pivoting around an axis 104, as indicated by the double-headed arrow 106.

Additionally, the stem 98 may pivot relative to the mounting portion 88 around a vertical axis.

All cooperating, relatively movable components may include a feature whereby different relative positions may be releasably held. The user thus has substantial flexibility in terms of reconfiguring the overall structure as, for example, to change the height and/or orientation of the receptacle 86.

The stem 98 may be fixed relative to the mounting portion 88 in a desired relationship or, alternatively, the body 84 may be allowed to turn around a vertical axis as the support 12*a* is rocked in a back and forth motion, as indicated by the double-headed arrow 100.

Figure 18:
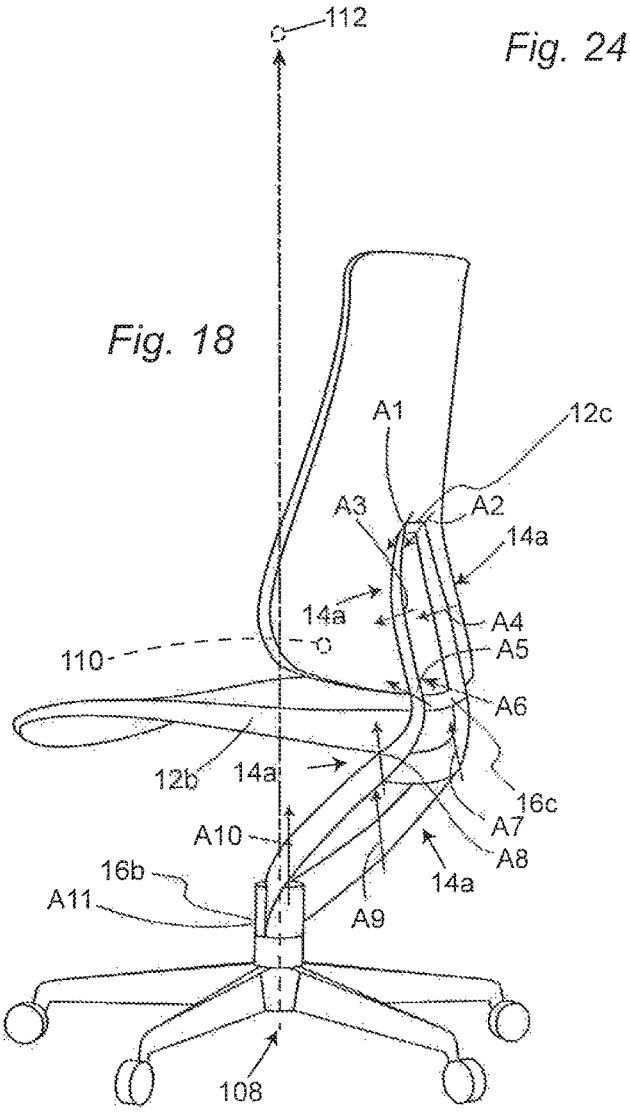
FIG. 18 is a perspective view of a task chair incorporating multiple motion transmitting assemblies, according to the invention to allow movement of a seat and backrest thereon.

In FIG. 18, the seat 12*b* and backrest 12*c* in FIG. 7 are shown incorporated into a wheeled carriage 108 using motion transmitting assemblies 14*a* to allow back and forth independent movement of the seat 12*b* and backrest 12*c*.

A mirrored arrangement of motion transmitting assemblies 14*a* is incorporated so that all pivot axes A1, A2, A3, A4, A5, A6 converge towards a pivot location at 110 that is at a hip of a user in a sitting position upon the seat 12*b*.

A mirrored arrangement of motion transmitting assemblies 14*a* is incorporated to support the seat 12*b* on the base 16*b*, atop the carriage 108, in a manner whereby the axes A7, A8, A9, A10, A11 converge towards a pivot location 112 that is above the backrest 12*c*. The axis A11 is a shared axis.

Thus, the seat 12*b* and backrest 12*c* can be moved independently of each other in separate back and forth non-straight paths relative to the carriage 108.

Figure 19:
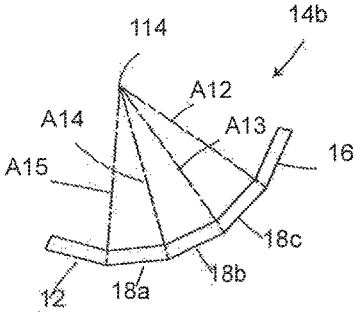
FIG. 19 is a schematic representation of another support structure according to the invention and with a motion transmitting assembly incorporating three link members between a support and base.

A further modified form of motion transmitting assembly is shown at 14*b* in FIG. 19 with three link members between a support and base 12, 16, respectively. All pivot axes A12, A13, A14, A15 converge towards a pivot location 114.

Figure 20:
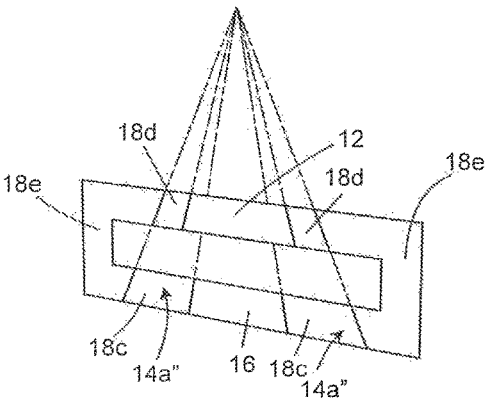
FIGS. 20 and 21 are schematic representations of an alternative form of human support structure using a different form of motion transmitting assembly and in two different states.
Figure 21:
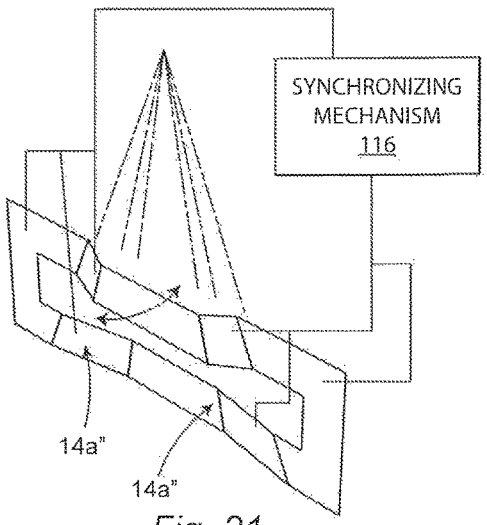

FIGS. 20 and 21 show a further form of movable human support structure that utilizes a mirrored arrangement of the modified form of the three axis motion transmitting assembly 14*a*, identified in FIGS. 20 and 21 as 14*a*" with link members 18*c*, 18*d*, 18*e*.

The support 12 moves in an arcuate path between the FIG. 20 and FIG. 21 states. In the FIG. 20 state, the link members 18*c*, 18*d* are coplanar. A synchronizing mechanism 116 may be incorporated to prevent binding or locking of the structure as it is changed from the FIG. 21 state to a state wherein the support 12 moves in its desired path over center past the coplanar relationship of FIG. 20. This allows the support 12 to move freely and smoothly back and forth through the full desired range of the non-linear path. The synchronizing mechanism 116 can be made using well-known technology, as by employing gears, pulleys/chains, belts, etc. As but one example, a link/component may connect between the link members 18*c*, 18*d*, 18*e* to achieve this objective. The link/component may be connected as by a hinge arrangement, ball and socket arrangement, etc. at its ends.

Figure 22:
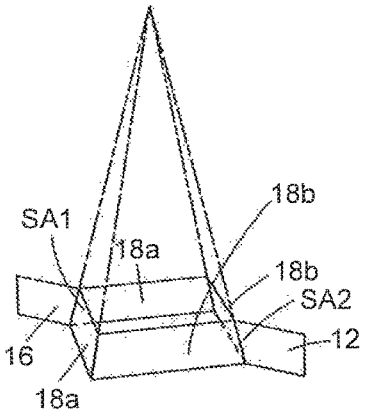

FIG. 22 shows a mirrored arrangement of motion transmitting assemblies, each with links 18*a*, 18*b* between a support 12 and base 16, and with two separate shared axes SA1, SA2.

Figure 23:
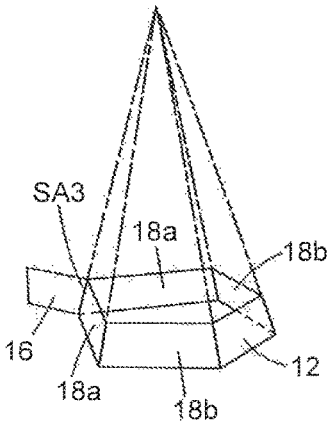

FIG. 23 shows similar components 18*a*, 18*b*, 12, 16 with a single shared axis SA3 for the base 16.

Figure 24:
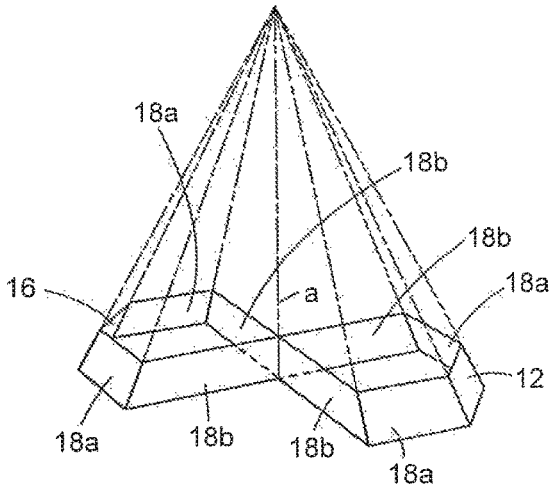

FIG. 24 shows an arrangement of components 18*a*, 18*b*, 12, 16 wherein the link member 18*b* is one continuous part, connected with an axis a at its center.

Multiple motion transmitting assemblies, with the same or different forms, may be combined, with one exemplary arrangement shown in FIGS. 25 and 26 and another shown in FIGS. 27 and 28, each utilizing the same basic components as in the various embodiments described above—support 12, base 16, and link members 18*a*, 18*b*.

In FIGS. 25 and 26, the support 12 and base 16 are shared.

In FIGS. 27 and 28, there is no connecting structure between the link members 18*a*, 18*b* in a gap as identified at 118.

FIGS. 29 and 30 show a further modified form of structure with combined motion transmitting assemblies utilizing the basic components—18*a*, 18*b*, 12, 16 but in a different, mirrored configuration. Movement of the support 12 is effected by collapsing one side 120 with the other side 122 extended.

The axes may converge to spaced pivot points 124, 126, as shown, or may alternatively converge towards a single pivot point.

Figure 31:
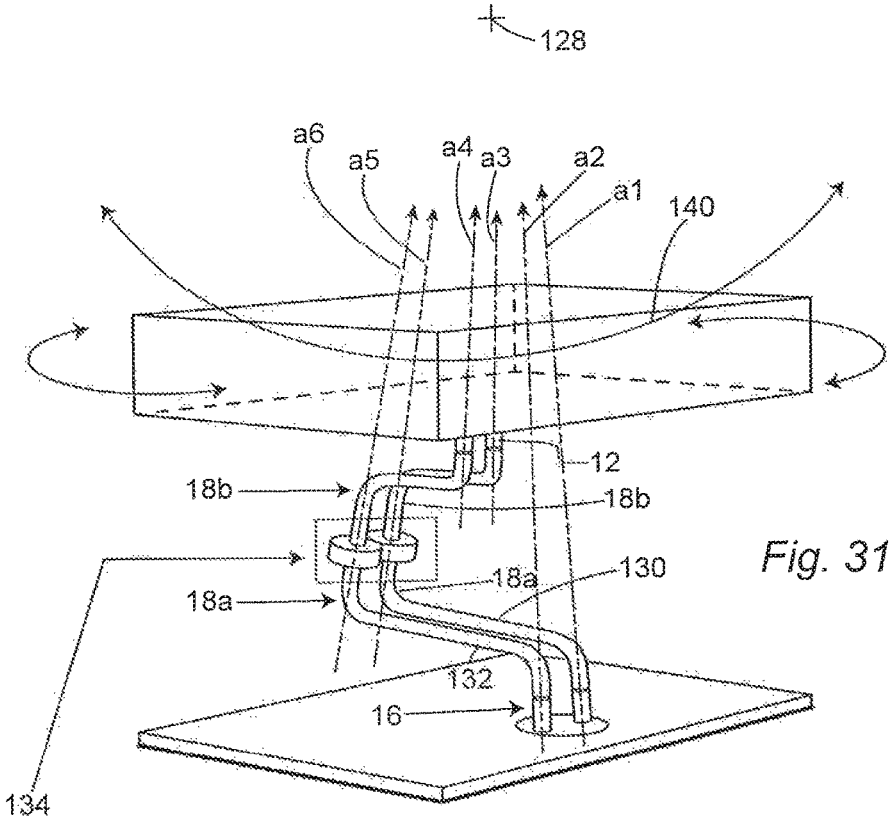
FIG. 31 is a perspective view of another form of human support assembly.

In FIG. 31, a further modified form of structure is depicted with more specific forms of link members 18*a*, 18*b*. Formed tubes define the link members 18*a*, 18*b*. All of the pivot axes a1, a2, a3, a4, a5, a6 converge to a single pivot point 128.

A synchronizing mechanism at 134 avoids binding or locking up due to over center positioning as the separate, similarly shaped, tubular configurations move towards a planar relationship. Again, this avoids a non-smooth movement of the support in any portion of the desired travel range.

Figure 32:
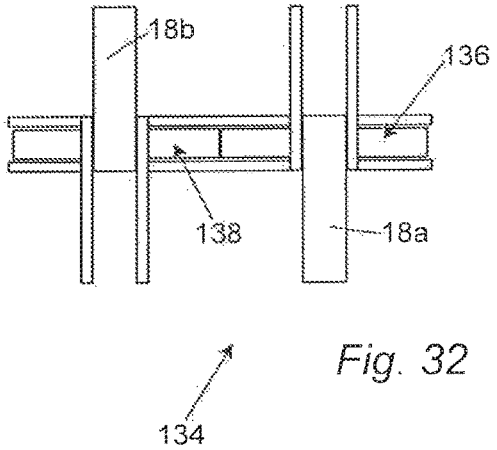
FIGS. 32-34 are fragmentary views showing different synchronizing structures for controlling relationship between link members on the structure in FIG. 31 as the support thereon is moved.

The synchronizing mechanism 134, shown in further detail in FIG. 32, may include cooperating components 136, 138, fixed respectively to the link members 18*a*, 18*b* on the tubes 130, 132, respectively. The components 136, 138 interact to coordinate movement of the link members 18*a*, 18*b* as the support 12 swings in a curved path, as indicated by the double-headed arrow 140. The components 136, 138 can be gears, pulleys, chains, belts, etc.

The synchronizing mechanism 134 could be incorporated at other locations to achieve the same objective.

Figure 33:
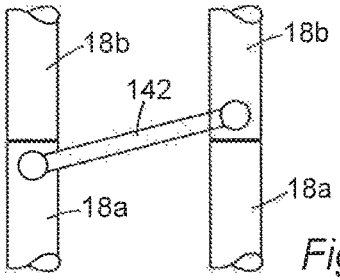
Figure 34:
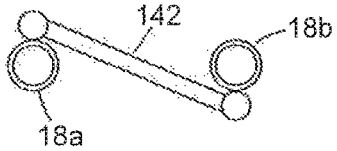

In one alternative form, as shown in FIGS. 33 and 34, a link member 142 has its ends pivotably to the link members 18*a*, 18*b* on the separate tubes 130, 132 to effect the desired synchronization.

Figure 35:
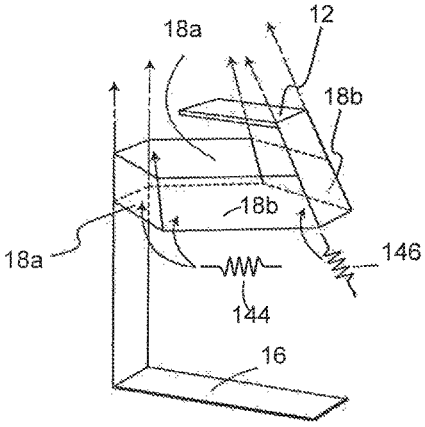
FIG. 35 is a schematic representation of spring members acting between the link members, support, and/or base to control and facilitate relative movement therebetween.

As shown schematically in FIG. 35, springs 144, 146 may connect between any of the components 18*a*. 18*b*, 12, 16 in a manner to assist counterbalancing and/or relative movement between components. The springs 144, 146 may act against a separate base or between any of the components, as described above, to effect the desired force transmission. The springs 144, 146 may be strategically placed compression springs or torsion springs. The springs 144, 146 may maintain an equilibrium position for components or may assist or control relative movement therebetween.

Figure 36:
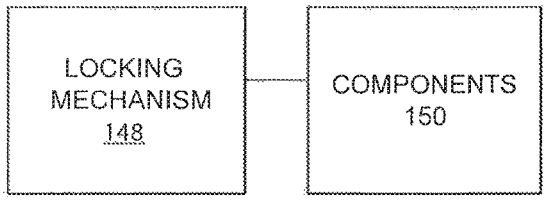
FIG. 36 is a schematic representation of a mechanism for locking relatively movable components on the inventive human support structure.

As shown in FIG. 36, a locking mechanism 148 may be incorporated to maintain the relationship between any two components on the structure or control relative movement therebetween. The components, identified in FIG. 37 generically at 150, include all components that move or are situated to have another component move relative thereto in operation.

As one example, it may be desired to fix the body 84 against movement, as when an infant is sleeping. The locking mechanism 148 may thus act between any of the components 150 to prevent any movement of the body 84 relative to the base 16. The locking mechanism 148 may be released/unlocked to allow normal movement of the body 84.

The locking mechanism 148 might alternatively be configured to control the permitted range of the non-linear path as by strategically blocking relative movement between components.

Figure 37:
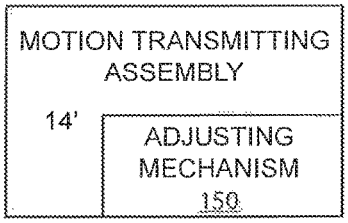
FIG. 37 is a schematic representation of an adjusting mechanism for link members, the support, and/or base to alter the operating characteristics of the associated human support structure.

As shown schematically in FIG. 37, the motion transmitting assembly 14', which is intended to be generic to all motion transmitting assemblies herein described and others, may incorporate an adjusting mechanism 150. The adjusting mechanism 150 may be configured as to change the angle between any of the pivot axes between the relatively movable support 12, base 16, and link members 18.

The adjusting mechanism 150 may also be configured so that the effective length/radius along any axis between any of the support 12, base 16, and link member 18 and the pivot location to which the respective axis is aligned towards, can be changed. This allows the effective radius of any arc in which a support 12 moves to be changed selectively as desired.

The adjusting and locking mechanisms 150, 148 may incorporate different conventional type components, such as gears, levers or linkages, Bowden cables with a lever, kick stands, ratchets, sliding connecting rods, toothed members, magnetically attracted components, etc. Arc length might be changed using components such as a crank, rack and pinion, slider, telescoping members, roller and track mechanism, gas cylinder, etc. Alternatively, linkage ends might be connected at different locations.

Any of the generically depicted connectors 20, 22, 24, 26 may interact so that they can be selectively separated to facilitate folding and compaction of the overall structure.

As shown schematically at 152 in FIG. 2, a powered drive 152 may be incorporated to change the relative positions between the support 12, base 16, and link members 18. The support 12 may thus be driven in its non-linear path in a back and forth motion without requiring any effort to be expended by a user.

To avoid excessive freedom of movement, a damping structure 152 may be incorporated, as shown schematically in the exemplary motion transmitting assembly 14 in FIG. 8. The damping structure 152 may simply bind relative movement between a link member 18 and one or both of the support 12 and base 16 to thereby avoid excessive freedom of movement. As but one example, a rubber bushing might be utilized.

For each embodiment wherein the axes converge towards a single pivot location, a modification might be made so that one or more of the axes go towards/converge towards a second pivot location. Similarly, those embodiments with multiple pivot locations might be modified to have a single pivot location, or have one or more axes changed to go through a different one of the multiple pivot locations.

The foregoing disclosure of specific embodiments is intended to be illustrative of the broad concepts comprehended by the invention.

The invention claimed is:

1. A movable human support structure comprising:

a support against which at least a part of a human bears in use;

a base; and a first motion transmitting assembly acting between the support and the base, the first motion transmitting assembly comprising at least one link member connecting between the base and the support, the first motion transmitting assembly configured so that relative movement is guided between: a) the at least one link member and support around a predetermined first axis: and b) the at least one link member and base around a predetermined second axis, the predetermined first and second axes non-parallel to each other, the first motion transmitting assembly configured such that a moving force imparted to the support causes simultaneous relative pivoting movement between the at least one link member and a) the support around the predetermined first axis: and b) the base around the predetermined second axis and movement of the support relative to the base is guided in a single, predetermined non-straight path.

2. The movable human support structure according to claim 1 wherein the at least one link member comprises a first substantially rigid link member having spaced locations pivotable relative to the support and base respectively around the predetermined first and second axes.

3. The movable human support structure according to claim 1 wherein the first motion transmitting assembly is configured so that the support traces first and second separate arcs as the support moves in the single, predetermined, non-straight path.

4. The movable human support structure according to claim 1 wherein the at least one link member comprises a plurality of link members, first and second of the plurality of link members connected to each other for relative movement around another axis that is non-parallel to the predetermined first and second axes.

5. The movable human support structure according to claim 1 wherein the first motion transmitting assembly is configured so that the radius of an arc can be selectively changed.

6. The movable human support structure according to claim 1 wherein the predetermined first and second axes are at an angle with respect to each other and the first motion transmitting assembly is configured so that the angle between the predetermined first and second axes can be selectively changed.

7. The movable human support structure according to claim 1 wherein the first motion transmitting assembly is configured so that the at least one link member can be selectively disconnected from one of: a) another link member making up the at least one link member; b) the base; and c) the support to facilitate collapsing/compaction of the movable human support structure.

8. The movable human support structure according to claim 1 wherein the support is in the form of one of: a) a seat; or b) a cradle for an infant.

9. The movable human support structure according to claim 1 wherein the support is in the form of one of: a) a seating surface; and b) a back support surface.

10. The movable human support structure according to claim 1 in combination with a drive for moving the support in the non-straight path.

11. The movable human support structure according to claim 1 wherein the first motion transmitting assembly comprises structure for one of: a) fixing the support in a selected position relative to the base; and b) selecting different ranges of movement for the support in the non-straight path.

12. The movable human support structure according to claim 1 wherein the predetermined first and second axes each extends primarily in a vertical direction.

13. The movable human support structure according to claim 1 wherein the support tilts as an incident of the support moving in the non-straight path.

14. The movable human support structure according to claim 1 wherein the predetermined first and second axes have a fixed spacing and relationship with each other.

15. A movable human support structure comprising:

a support against which at least a part of a human bears in use;

a base;

a first motion transmitting assembly acting between the support and the base, the first motion transmitting assembly comprising at least one link member connecting between the base and the support, the at least one link member configured to be pivotable: a) relative to the support around a first axis; and b) relative to the base around a second axis, the first and second axes non-parallel to each other, the first motion transmitting assembly configured to guide movement of the support relative to the base in opposite directions in a non-straight path; and a second motion transmitting assembly connecting between the support and the base, the second motion transmitting assembly comprising at least a second link member connecting between the base and the support, the at least second link member configured to be movable: a) relative to the support around a third axis; and b) relative to the base around a fourth axis, the third and fourth axes non-parallel to each other.

16. The movable human support structure according to claim 15 wherein the predetermined first and second axes converge towards a first pivot location and the third and fourth axes converge towards a second pivot location that is spaced from the first pivot location.

17. The movable human support structure according to claim 5 wherein the first, second, third, and fourth axes converge towards a single pivot location.

18. The movable human support structure according to claim 15 wherein two of the first, second, third, and fourth axes are shared/coincident.

19. The movable human support structure according to claim 15 wherein at least one of the at least one link member and at least one of the at least second link member is a shared link member between the first and second motion transmitting assemblies.

20. The movable human support structure according to claim 15 further comprising structure in addition to the link members cooperating between components on each of the first and second motion transmitting assemblies to coordinate movement between the components on the first and second motion transmitting assemblies as the support moves relative to the base in the non-straight path.

21. A movable human support structure comprising:

a support against which at least a part of a human bears in use;

a base; and a first motion transmitting assembly acting between the support and the base, the first motion transmitting assembly comprising at least one link member connecting between the base and the support, the at least one link member connected to the support at a first joint and to the base at a second joint, the at least one link member pivots: a) at the first joint relative to the support around a predetermined first axis: and b) at the second joint relative to the base around a predetermined second axis, the first and second axes non-parallel to each other, the first motion transmitting assembly configured to guide movement of the support relative to the base in opposite directions in a non-straight path, wherein the predetermined first and second axes converge towards a pivot location.

22. The movable human support structure according to claim 21 wherein the pivot location is above the support.

* * * * *